US005613474A

United States Patent [19]

Nakamura et al.

[11] Patent Number: 5,613,474

[45] Date of Patent: Mar. 25, 1997

[54] CONTROL METHOD FOR STARTING DIESEL ENGINES

[75] Inventors: Tadao Nakamura, Oyama, Japan; Makoto Watanabe, Madison, Wis.; Tatsuro Nakazato, Hiratsuka, Japan

[73] Assignee: Komatsu Ltd., Tokyo, Japan

[21] Appl. No.: 591,644

[22] PCT Filed: Aug. 10, 1994

[86] PCT No.: PCT/JP94/01321

§ 371 Date: Feb. 12, 1996

§ 102(e) Date: Feb. 12, 1996

[87] PCT Pub. No.: WO95/05536

PCT Pub. Date: Feb. 23, 1995

[30] Foreign Application Priority Data

Aug. 13, 1993 [JP] Japan ..... 5-220524

[51] Int. Cl.[6] ..... F02M 37/04

[52] U.S. Cl. ..... 123/496; 123/179.17; 123/357

[58] Field of Search ..... 123/496, 179.17, 123/373, 365, 357

[56] References Cited

U.S. PATENT DOCUMENTS

| | | | |
|---|---|---|---|
| 4,211,203 | 7/1980 | Kobayashi | 123/496 |
| 4,479,474 | 10/1984 | Djordjevic | 123/179.17 |
| 4,665,873 | 5/1987 | Yogome | 123/179.17 |
| 4,667,633 | 5/1987 | Stompp | 123/357 |
| 4,709,335 | 11/1987 | Okamoto | 123/357 |
| 5,076,239 | 12/1991 | Mina | 123/496 |
| 5,193,505 | 3/1993 | Straubel | 123/179.17 |
| 5,339,781 | 8/1994 | Osawa | 123/357 |

FOREIGN PATENT DOCUMENTS 1-178735 5/1989 Japan .

*Primary Examiner*—Carl S. Miller
*Attorney, Agent, or Firm*—Sidley & Austin

[57] ABSTRACT

A control method for starting a diesel engine makes it possible to prevent an excessive increase in fuel injection rate in a low speed rotation range at the time of starting for prevention of occurrence of misfiring and unstable engine rotation, and to prevent occurrence of black smoke by controlling the injection rate according to the engine temperature. For this effect, from the beginning of engine starting to a first engine rotating speed ($N_1$), the control rack is moved in the fuel injection rate reducing direction so that the rack position has a first gradient to correct for an increase in fuel injection rate and, from the first engine rotating speed to a second engine rotating speed ($N_3$) at which the control rack is returned to its position for ordinary control, the control rack is moved in the fuel injection rate reducing direction so that the rack position has a second gradient greater than the first gradient.

20 Claims, 5 Drawing Sheets

CONTROL METHOD FOR STARTING DIESEL ENGINES

TECHNICAL FIELD

The present invention relates to the control of diesel engines at the time of starting and, more particularly, to the control of a control rack position for an increase in the amount of fuel at the time of starting for improving the startability of the engine.

BACKGROUND ART

In recent years, as a means for coping with regulations of exhaust from diesel engines, the development of injection nozzles having smaller nozzle orifice diameters and injection pumps having higher pumping pressure has been promoted to atomize injected fuel more finely. Formerly, in many cases, the startability at a low temperature could be improved by injecting more fuel by means of a starting increase function or the like. However, atomization of fuel promotes vaporization of fuel during the ignition lag period. Therefore, if the amount of injected fuel is excessively large, the fuel takes a large amount of heat of vaporization, reducing the temperature in the engine so that misfire can occur as an effect contrary to the original purpose. There is, therefore, a need for more accurate control of the fuel injection rate.

For example, in an in-line fuel injection pump or the like for diesel engines, the position of a control rack for injection rate adjustment (hereinafter referred to as "rack" or "control rack") of a governor is controlled to change the rate of injection of fuel into the engine. However, even when the position of the rack is fixed, the fuel injection rate is not constant with respect to the engine rotating speed. That is, an ordinary characteristic of an injection pump is such that, as shown in FIG. 6, the fuel injection rate decreases if the engine rotating speed becomes lower when the rack position is fixed. This tendency is stronger in a very low engine speed range.

On the other hand, to improve the startability of an engine, it is necessary to supply the engine with fuel at a rate high enough to achieve such an engine rotating speed that the engine can rotate against resistance. In a diesel engine using a mechanical governor, therefore, the fuel injection rate is increased in a lower rotating speed range at the time of starting the engine relative to the fuel injection rate at the time of ordinary control. In this method, a starting increase mode is set in which the rack position at the time of starting is on the fuel injection rate increasing side of the rack position at the time of ordinary control, as indicated by the hatched area in FIG. 7, thereby increasing the fuel injection rate at the time of starting.

This starting increase is effected by using a spring which is called a start spring and which is comparatively weak in tensile force. Between A and B, after an engine start and before the rotating speed becomes equal to $N_1$, the rack position is constantly maintained stationary, by being stopped by a stop mechanism such as a rack cap. The rack position between B and C, from the rotating speed $N_1$ to the rotating speed $N_2$, is determined by the balance between the tensile force of the start spring and the centrifugal force of a fly weight of the governor. However, since the spring force is weak, the rack position changes abruptly to its ordinary control position, by moving in the injection rate reducing direction with a steep gradient to reduce the amount of starting increase to zero.

There is another method using an electronic governor for electronically controlling the amount of operation of an actuator for operating the control rack to adjust the fuel injection rate. Also in this case, a control mode of increasing the injection rate at the time of starting, as shown in FIG. 8, is adopted. In this starting increase mode, the starting increase action of the mechanical governor is directly replaced with the electronic governor, as is apparent from the figure. That is, between a and b, before the engine rotating speed becomes equal to $N_1$, the rack position is constantly maintained stationary so that the amount of increase is $X_0$. The rack position is rapidly adjusted between b and c, in which the rotating speed changes from $N_1$ to $N_2$, and the amount of increase is thereby set to zero at $N_2$. Such setting is made in almost all cases. The change between b and c of FIG. 8 is called regulation R and is expressed by $$R=\{(N_2-N_1)/N_1\}\times 100(\%) \quad (1)$$

The value of the regulation R is ordinarily 20% or less.

However, considering the points described below, it cannot be said that the setting of the above-described conventional starting increase mode is optimal and effective in sufficiently improving the startability. In the conventional starting increase mode, as shown in FIG. 7 or 8, the rack position is constantly maintained stationary between A and B or between a and b. However, in a very low speed range of the engine rotating speed, the fuel injection rate increases abruptly as the rotating speed becomes higher even when the rack position is constant, as shown in FIG. 6. For this reason, even if the rack position is set for an optimal injection rate at the point A or a at the beginning of the starting time, fuel is necessarily injected at an excessively high rate at the point B or b, at which the engine rotating speed becomes equal to $N_1$. Thus, the conventional starting increase mode entails the problem of occurrence of misfire due to an increase in the heat of vaporization taken by the fuel. Further, between B and C or between b and c, the rack position is rapidly returned to the ordinary control position, so that the fuel injection rate decreases abruptly. Therefore, when the resistance to rotation is large, for example, in the case where the temperature of the engine is low, a situation can occur easily wherein the rotating speed cannot be increased as desired because fuel is not sufficiently supplied.

SUMMARY OF THE INVENTION

The present invention has been accomplished to eliminate these drawbacks of the conventional art, and a first object of the present invention is to provide a control method for starting a diesel engine, which makes it possible to prevent an excessive fuel injection during starting injection rate increasing. A second object of the present invention is to reliably increase the rotating speed at the time of starting, even under a low-temperature engine condition or the like. A further object of the present invention is to prevent an unnecessary increase in the rotating speed of an engine.

To achieve these objects, according to the present invention, there is provided a control method for starting a diesel engine characterized in that, between the beginning of the engine starting and a predetermined first engine rotating speed, the control rack is moved in the fuel injection rate reducing direction so that the rack position has a first gradient with respect to the engine rotating speed to correct for an increase in fuel injection rate accompanying an increase in engine rotating speed and, between the first engine rotating speed and a second engine rotating speed at which the control rack is returned to its position for ordinary control, the control rack is moved in the fuel injection rate reducing direction so that the rack position has a second gradient greater than the first gradient with respect to the engine rotating speed. It is desirable that the ratio of the difference between the first engine rotating speed and the second engine rotating speed to the first engine rotating speed is set to a value larger than 20% to increase the so-called regulation range. Preferably, the position of the control rack, at the beginning of starting the engine, changes between predetermined positions for different increases in the fuel injection rate according to a temperature of the engine. Further, if the temperature of the engine is not higher than a predetermined temperature, the control rack is moved in the fuel injection rate reducing direction so that the rack position has a predetermined third gradient, which is smaller than the second gradient, with respect to the engine rotating speed, from the engine rotating speed at the time when the control rack reached a predetermined position during its movement with the second gradient until the engine rotating speed increases to a predetermined third engine rotating speed which is higher than the second engine rotating speed. Alternatively, if the temperature of the engine is not higher than a predetermined temperature, the control rack can be maintained at a predetermined position, reached by the control rack during the movement with the second gradient, until the engine rotating speed increases from the engine rotating speed, at the time when the control rack reached the predetermined position, to a predetermined third engine rotating speed, which is higher than the second engine rotating speed, and the control rack can be moved in the fuel injection rate reducing direction from the third engine rotating speed to be returned to its position for ordinary control.

By this arrangement, an increase in the fuel injection rate accompanying an increase in engine rotating speed is corrected from the beginning of starting the engine to the first rotating speed. The increase in injection rate for starting in the corresponding period can be thereby maintained generally constantly. Occurrence of an excessive increase in fuel injection rate is thereby avoided to prevent misfire due to an increase in heat of vaporization of fuel. Also, an abrupt reduction in fuel injection rate is prevented by increasing the so-called regulation range, so that the necessary amount of fuel for increasing the rotating speed can be maintained even if the resistance to rotation is larger under a low-temperature engine condition or the like. Further, by changing the increase in fuel injection rate according to the temperature of the engine at the time of starting, for example, by setting the position of the control rack on the injection rate reducing side if the engine temperature is high at the time of starting, the injection of surplus fuel is inhibited when the engine is started in a sufficiently warmed condition, thereby preventing generation of black smoke. Further, when the engine temperature is not higher than a predetermined temperature, excessive fuel injection can be prevented by increasing the engine rotating speed to a higher speed with the smaller and gentler third gradient. Therefore, warming-up immediately after starting can be suitably performed, so that the engine rotation is stable. In the conventional art, in contrast with the present invention, the engine rotating speed is increased after a change from the starting mode to the ordinary control mode, so that misfire due to an excessive amount of fuel can occur easily and the engine rotation is unstable, as described above. Warming-up immediately after starting can also be suitably performed by maintaining the control rack at a predetermined position if the engine temperature is not higher than a predetermined temperature. When the engine temperature is not higher than a predetermined temperature, moving the rack in the injection rate reducing direction or maintaining the rack at a predetermined position is selected according to starting characteristics of engines.

BEST MODE FOR CARRYING OUT THE INVENTION

A preferred embodiment of a control method for starting a diesel engine in accordance with the present invention will be described with reference to the accompanying drawings.

Figure 1:
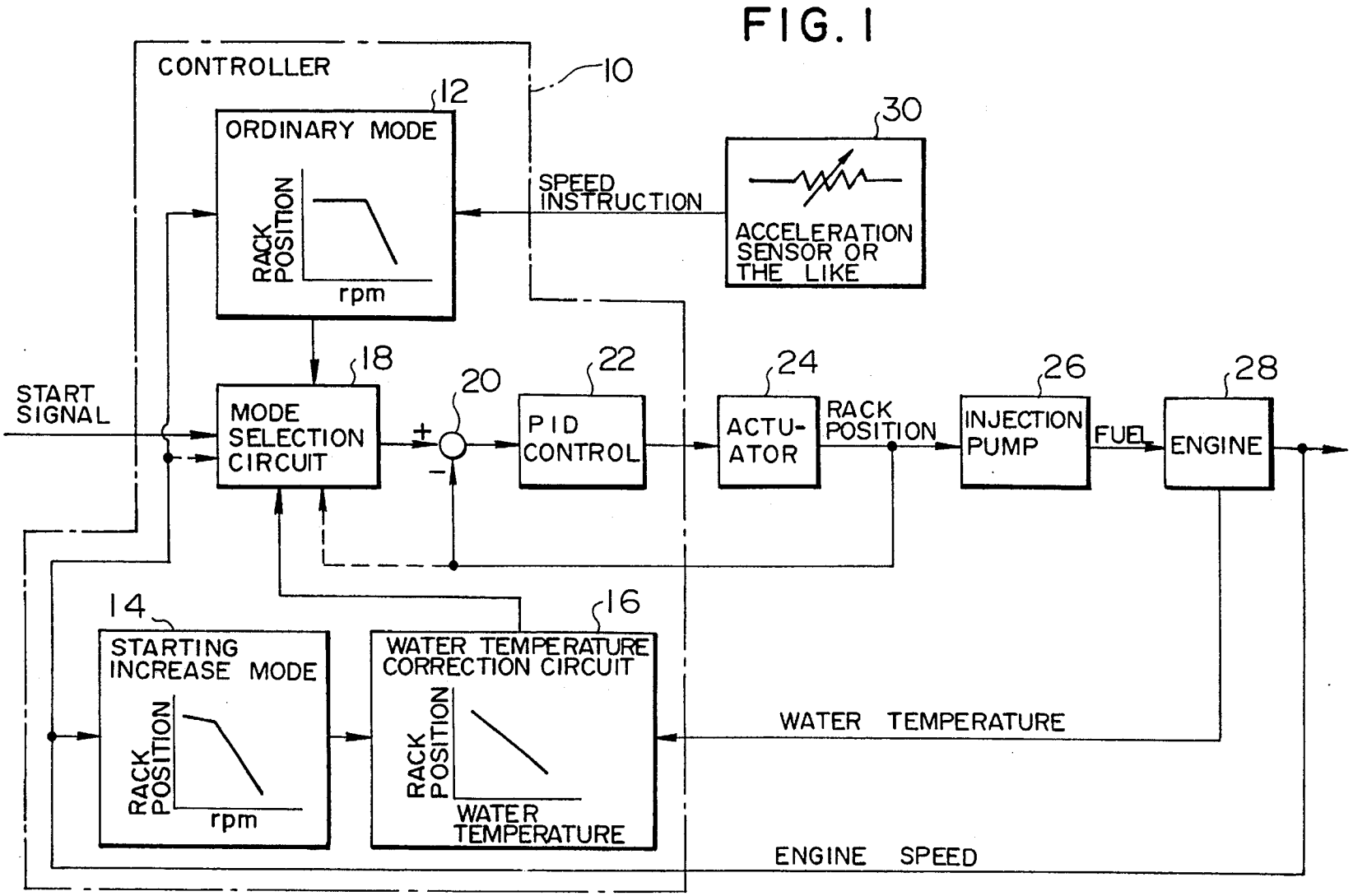
FIG. 1 is a block diagram showing an example of an engine controller for carrying out a control method for starting a diesel engine in accordance with an embodiment of the present invention.

FIG. 1 is a block diagram showing an example of an engine controller of this embodiment. In this embodiment, which is based on an electronic governor, a controller 10 has an ordinary mode output section 12 and a starting increase mode output section 14. The ordinary mode output section 12 stores the control rack position of the governor with respect to the engine rotating speed during ordinary control at the time of high-speed rotation, low-speed rotation and the like of an engine 28. The rack positions with respect to the engine rotating speed stored by the ordinary mode output section 12 is substantially the same as that of the conventional control mode. On the other hand, the starting increase mode output section 14 stores the control rack position with respect to the engine rotating speed when the engine is started.

Figure 3:
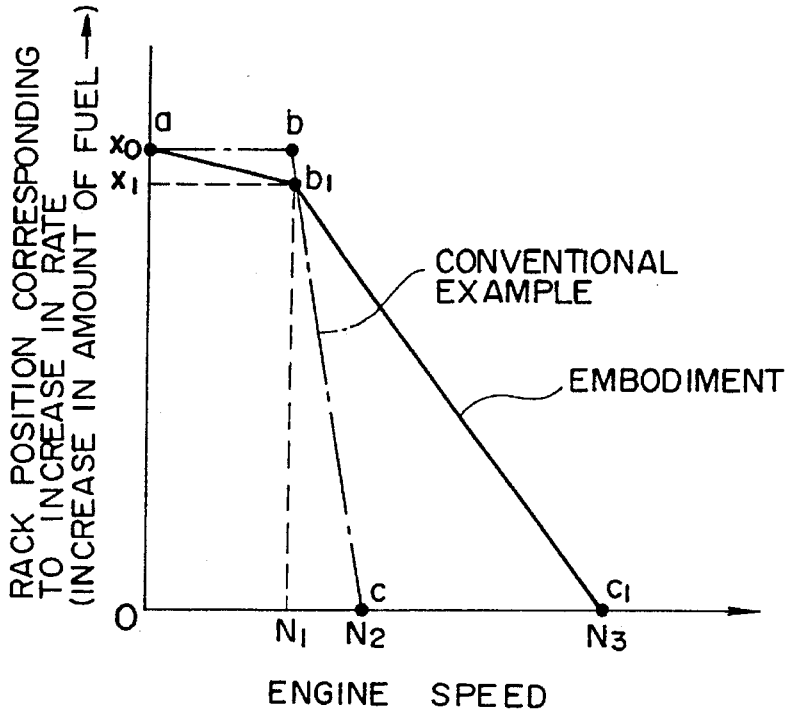
FIG. 3 is a graph for explaining a mode of controlling the starting-increase rack position in accordance with the embodiment.

A control mode of the rack position stored in the starting increase mode output section 14 is as indicated by the solid line in FIG. 3. That is, in the rack position control mode of this embodiment, the rack position at the time a of starting the engine is set at the same position $X_0$ as in the conventional art. However, while the rack position at a rotating speed $N_1$ (e.g., 300 rpm) is maintained at $X_0$ in the conventional art, the corresponding rack position is set to $X_1$ which is on the fuel injection rate reducing side of $X_0$, thereby correcting an increase in the fuel injection rate due to an increase in engine rotating speed, so that the injection rate can be maintained generally constantly. That is, in the rack position control mode at the time of starting, the rack position has a predetermined first gradient with respect to the engine rotating speed between the beginning of starting and the rotating speed $N_1$ as the first engine rotating speed (between a and $b_1$). The first gradient is set so that the control rack moves in the injection rate reducing direction as the rotating speed increases, thereby preventing an excessive increase in injection rate which otherwise accompanies an increase in engine rotating speed.

Subsequently, between $b_1$ and $c_1$, when the rotating speed is higher than $N_1$, the rack position has a second gradient greater than the first gradient with respect to the rotating speed, and the rack moves in the injection rate reducing direction as the rotating speed becomes higher. The starting injection rate increasing is completed at an engine rotating speed $N_3$ (e.g., 1000 rpm) which is a second engine rotating speed. This rotating speed $N_3$ is increased relative to the rotating speed $N_2$ of the conventional example so that the regulation range is large. That is, the regulation R of this embodiment is about 230% if the rotating speed $N_3$ is calculated as $N_2$ in the equation (1) shown above in "Background Art". This value is larger than that of the conventional example. This regulation R is set according to engine characteristics, a starting environment and so on, and a value larger than 20% can be used as the regulation R. Preferably, the upper limit of the regulation R is such that a rated output is at a rotating speed approximately equal to the rotating speed $N_3$. For example, if $N_3$ is 2000 rpm (rated output), the upper limit is about 600%. Accordingly, a preferable range of regulation R is $20\%<R\leqq 600\%$. Further, if the efficiency with respect to fuel consumption or the like is a consideration, $30\%<R\leqq 300\%$ is more preferable. The rate of movement of the control rack with respect to the increase (change) in engine rotating speed is thereby reduced to prevent the fuel injection rate from decreasing abruptly with an increase in rotating speed. Also, the rotating speed of the engine 28 can be reliably increased even if the temperature of the engine is so low that the resistance to rotation is considerably large.

The controller 10 is further provided with a water temperature correction circuit 16, a mode selection circuit 18, a deviation calculation circuit 20, and a proportional integral and differential (PID) control circuit 22 on the output side of the starting increase mode output section 14. The water temperature correction circuit 16 has rack position correction values corresponding to temperatures of water for cooling the engine. The water temperature correction circuit 16 corrects the rack position output from the starting increase mode output section 14 according to the temperature of the engine cooling water and outputs the corrected position to the mode selection circuit 18, as described later in detail. The ordinary mode output section 12 is connected to the mode selection section 18. The mode selection circuit 18 outputs the rack position supplied from the ordinary mode output section 12 or the water temperature correction circuit 16 to the deviation calculation circuit 20 according to the existence/non-existence of a start signal input from a start switch or the like. The deviation calculation circuit 20 calculates a deviation between the control target rack position and the actual rack position. The PID control circuit 22, provided on the output side of the deviation calculation circuit 20, calculates the amount of operation of an actuator 24 for moving the control rack (not shown) on the basis of a signal outputted from the deviation calculation circuit 20, and operates the actuator 24 to adjust the position of the rack.

The control rack moved by the actuator 24 determines the injection rate of an injection pump 26 for injecting fuel into the engine 28. The position of the rack is detected by an unillustrated rack position sensor to be input to the deviation calculation circuit 20 and the mode selection circuit 18. The engine 28 is provided with a water temperature sensor for detecting the temperature of cooling water and a speed sensor for detecting the rotating speed of the engine 28 (both not shown). The cooling water temperature from this cooling water temperature sensor is inputted to the cooling water temperature correction circuit 16, and the engine rotating speed from the speed sensor is inputted to the starting increase mode output section 14, the mode selection circuit 18 and the ordinary mode output section 12. Further, a speed instruction signal is inputted to the ordinary mode output section 12 from a speed instruction output section 30 of an acceleration sensor or the like for detecting the amount of depression of an accelerator pedal.

Figure 2:
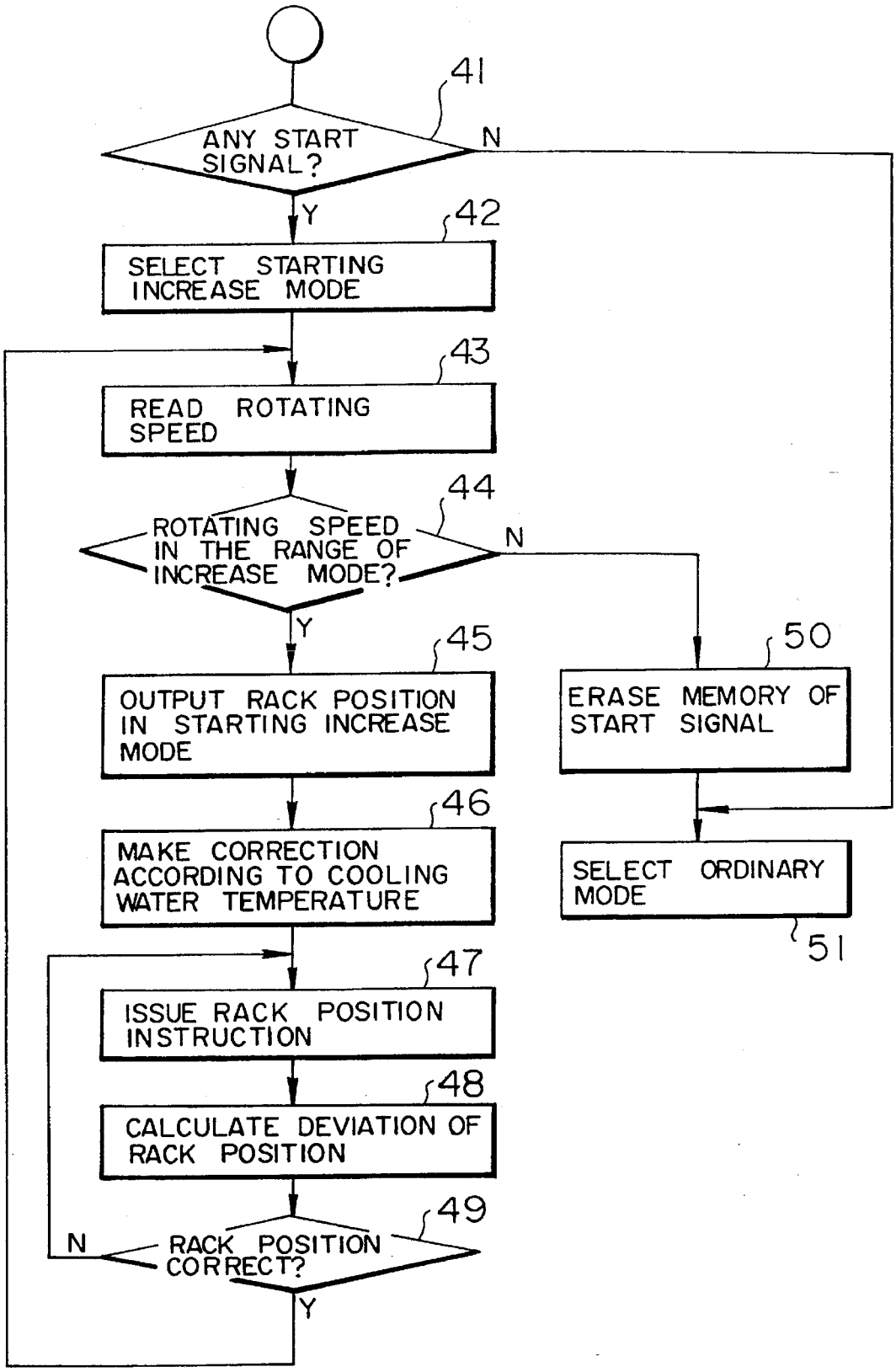
FIG. 2 is a flowchart for explaining the operation of the controller of FIG. 1.

The diesel engine starting control method using this arrangement is practiced as described below. First, referring to FIGS. 1 and 2, the mode selection circuit 18 is monitoring whether there is a start signal for engine 28 (starting signal) (Step 41). If there is no start signal, the ordinary control mode is selected (Step 51), and the output signal from the ordinary mode output section 12 is supplied to the deviation calculation circuit 20. On the other hand, when the mode selection circuit 18 is supplied with a start signal by turning on the starter switch or by other means, it stores the start signal in an unillustrated memory circuit and selects the starting increase mode to enable reading of the output signal from the water temperature correction circuit 16 with advancement from Step 41 to Step 42. Also, the mode selection circuit 18 reads the rotating speed of the engine 28 outputted from the speed sensor (Step 43) and makes a determination as to whether the present rotating speed is within the range of the starting increase mode (Step 44). If the engine rotating speed is such that the starting increase mode is required, that is, if the engine speed is not higher than $N_3$ shown in FIG. 3, it fetches the output signal from the water temperature correction circuit 16.

On the other hand, the starting increase mode output section 14 outputs the rack position $X_0$ at the beginning of starting (see FIG. 3) and outputs the control rack position corresponding to the rotating speed from the speed sensor to the water temperature correction circuit 16 (Step 45).

Next, the water temperature correction circuit 16 reads the temperature of the engine cooling water that changes according to the temperature of the engine 28, corrects the rack position output from the starting increase mode output section 14, according to the water temperature, and inputs the corrected position to the mode selection circuit 18 (Step 46). That is, the water temperature correction circuit 16 has a correction value table (see FIG. 1) such that, as the temperature of the cooling water of the engine 28 becomes higher, the rack is positioned on the injection rate reducing side. By using this table, the water temperature correction circuit 16 corrects the rack position outputted from the starting increase mode output section 14 in the injection rate reducing direction by a correction value corresponding to the temperature from the water temperature sensor, and outputs the corrected position to the mode selection circuit 18.

Figure 4:
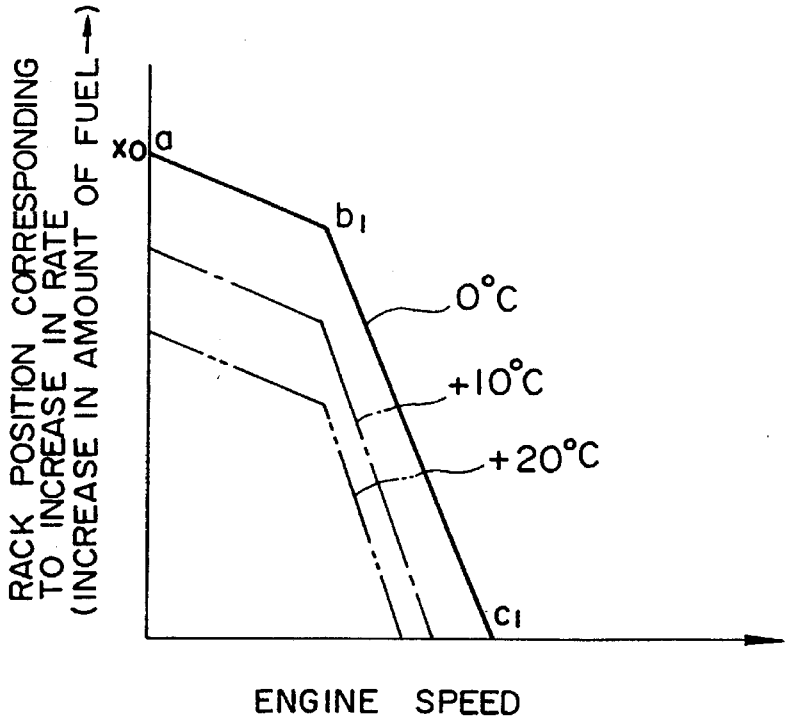
FIG. 4 is a graph for explaining a rack position control mode with respect to changes in engine cooling water temperature in accordance with the embodiment.

This correction value is determined, for example, on the basis of a cooling water temperature of 0° C. The correction value is 0 when the cooling water temperature is equal to or lower than 0° C., and becomes greater corresponding to the increase in the water temperature above 0° C. The water temperature correction circuit 16 subtracts the correction value from the rack position output from the starting increase mode output section 14 to obtain a corrected rack position output. The corrected rack position thereby outputted is the same as that outputted by the starting increase mode output section 14 when the cooling water temperature is 0° C., as indicated by the solid line in FIG. 4. However, the corrected rack position is as indicated by the dot-dash line when the cooling water temperature is 10° C. and as indicated by the double-dot-dash line when the cooling water temperature is 20° C.

The corrected rack position, outputted by the water temperature correction circuit 16, is outputted as a rack position instruction to the deviation calculation circuit 20 by the mode selection circuit 18 (Step 47). The deviation calculation circuit 20 calculates a deviation between the actual rack position, detected by the rack position sensor, and the rack position from the mode selection circuit 18 (Step 48), and sends this deviation to the PID control circuit 22. The PID control circuit 22 drives the actuator according to the magnitude of deviation calculated by the deviation calculation circuit 20 to adjust the rack position.

The mode selection circuit 18 also makes a determination based on the output signal from the rack position sensor as to whether this position coincides with the rack position in accordance with the instruction (Step 49). If they do not coincide with each other, the process returns to Step 47 and the rack position instruction from the mode selection circuit 18 is again outputted to the deviation calculation circuit 20 to correct the rack position. When the rack is corrected to the proper position, the process returns to Step 43 and the mode selection circuit 18 reads the rotating speed of the engine 28. If it is determined that the thus read rotating speed is larger than $N_3$ and that there is no need for the starting increase mode, the process moves from Step 44 to Step 50 to erase the stored start signal. The ordinary mode is then selected and the output signal from the ordinary mode output section 12 is read and supplied to the deviation calculation circuit 20 (Step 51). The deviation calculation circuit 20 and the PID control circuit 22 control the rack position on the basis of a rack position instruction from the ordinary mode output section 12 outputted by the mode selection circuit 18, as in the case of the starting increase mode described above.

In this embodiment, as described above, as the engine rotating speed is increased, the rack position corresponding to a condition of the engine rotating at a very low speed changes in the fuel injection rate reducing direction to correct the increase in fuel injection rate so that the fuel injection rate is generally constant. Occurrence of an unnecessary high injection rate experienced in the conventional art of constantly maintaining the rack position stationary is thereby reduced, thereby making it possible to obtain an optimal starting increase in the case of small-orifice injection and to prevent occurrence of misfire due to an increase in heat of vaporization. Also, the regulation range is extended to prevent an abrupt reduction in fuel injection rate, so that the injection rate necessary for increasing the engine rotating speed can be maintained to reliably increase the rotating speed even if the resistance to the rotation of the engine is large under a low engine temperature condition or the like. Further, the rack position is corrected in the injection rate reducing direction according to the level of the engine cooling water temperature, thereby enabling prevention of occurrence of black smoke from surplus fuel when the engine, already sufficiently warmed up, is started.

Figure 5:
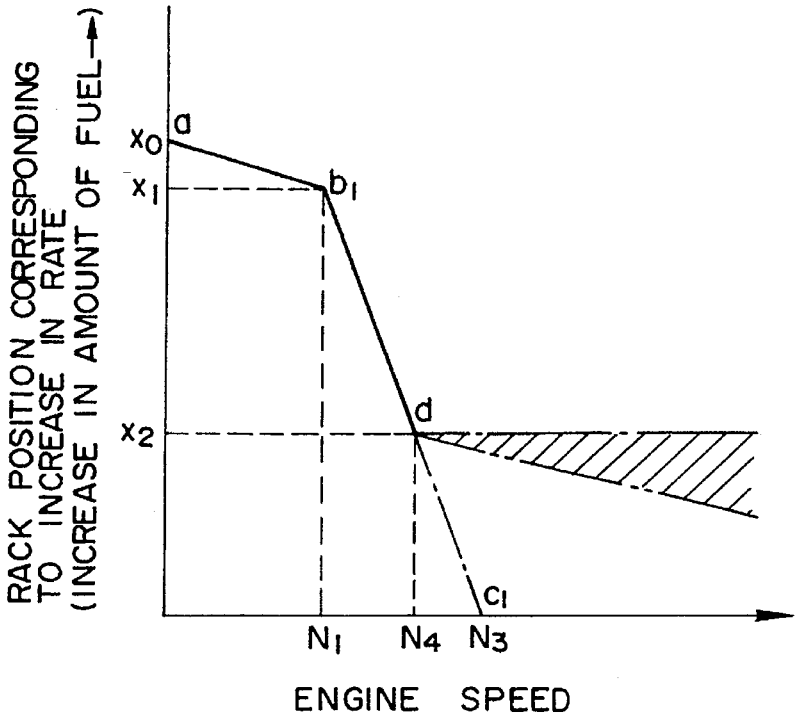
FIG. 5 is a graph for explaining a rack position control mode when the engine rotating speed is increased to a higher speed immediately after starting in accordance with an applied example.
Figure 6:
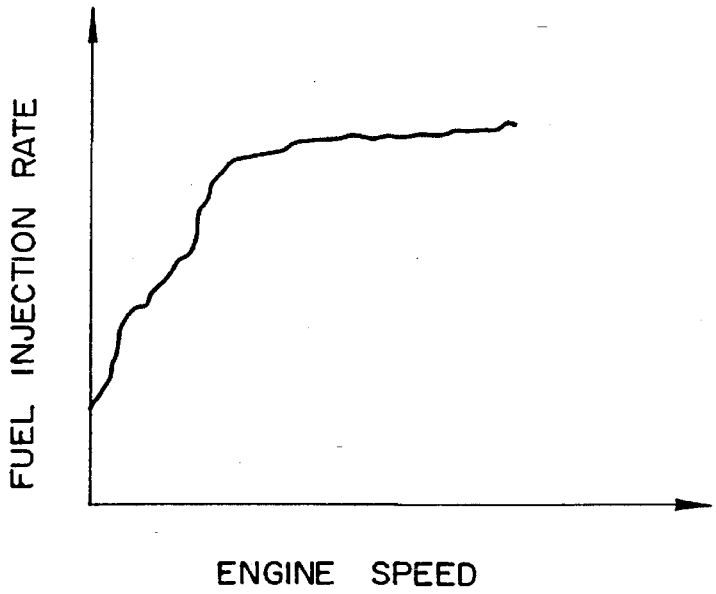
FIG. 6 is a graph showing an ordinary relationship between the change in engine rotating speed and the fuel injection rate in a case where the rack position is constant.
Figure 7:
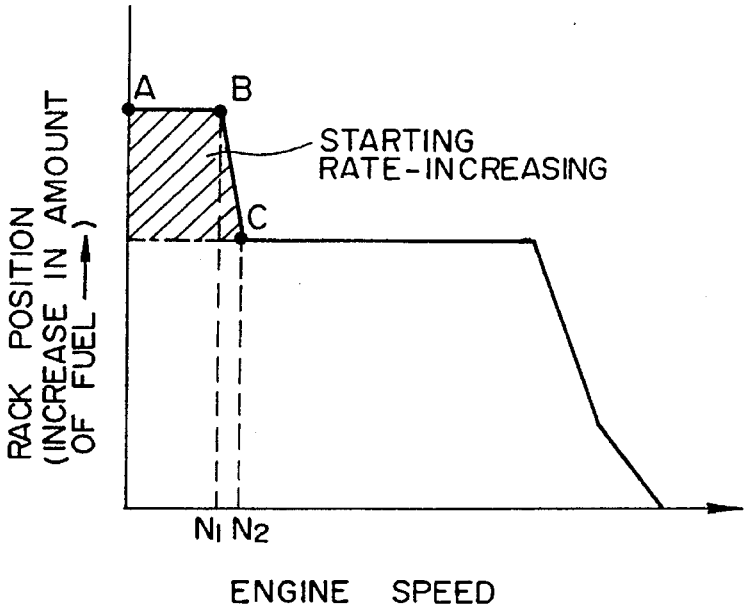
FIG. 7 PRIOR ART
FIG. 7 is a graph showing a mode of controlling the starting-increase rack position in a mechanical governor in accordance with the conventional art.
Figure 8:
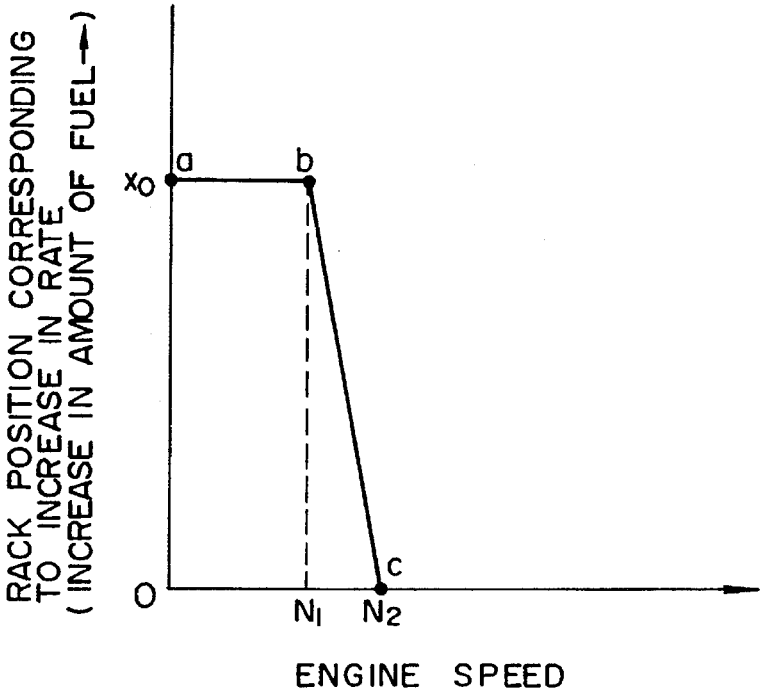
FIG. 8 PRIOR ART
FIG. 8 is a graph showing a mode of controlling the starting-increase rack position in an electronic governor in accordance with the conventional art.

An example of an application of the above-described embodiment will next be described with reference to FIG. 5. This applied example relates to a case where the engine rotating speed is increased to a high speed for the purpose of warming-up or the like immediately after staring the engine. FIG. 5 shows a rack position control mode at the time of starting the engine.

In the rack position control mode of this applied example, the control between a and $b_1$, from the beginning of starting to the engine rotating speed $N_1$, is the same as that of the above-described embodiment, and the rack is moved in the reducing direction so that the increase rack position has the first gradient with respect to the rotating speed. When the engine rotating speed exceeds $N_1$, the rack is moved in the injection rate reducing direction (the direction from $b_1$ to $c_1$) so that the rack position has the second gradient, as in the above-described embodiment. During this movement, the rotating speed increases to $N_4$ ($N_4<N_3$) and the rack moves to the predetermined position $X_2$ (point d). This predetermined position $X_2$ is, for example, at 30% of the maximum rack movement position $X_0$ for starting increase.

After the above-mentioned movement to the point d, the rack is moved in the injection rate reducing direction so that the rack position has a predetermined third gradient smaller and gentler than the second gradient with respect to the rotating speed of the engine until the engine rotating speed becomes equal to a rotating speed $N_5$ (not shown) which is a third engine rotating speed higher than $N_3$. By this movement, when the rotating speed becomes equal to $N_5$, the starting increase position of the rack is set to 0, thereby completing the rack position control mode at the time of starting the engine. The control can alternatively be such that, after the above-mentioned movement to the point d, the rack position is maintained at the predetermined position $X_2$ until the engine rotating speed becomes equal to the above-mentioned predetermined rotating speed $N_5$, and is moved in the injection rate reducing direction from the rotating speed $N_5$, and the starting control is finished at the starting increase position of 0. The selection of maintaining the rack position at $X_2$ or changing the rack position in the injection rate reducing direction after the above-mentioned movement to the position d and the setting of the gradient with respect to the rotating speed in the case of changing the rack position in the injection rate reducing direction depend upon characteristics of engines and are determined as desired by experiment or the like.

By the above-described arrangement, the engine rotating speed is increased to a higher speed for the purpose of warming-up or the like after starting. Therefore, an excessive increase in fuel injection rate can be limited to prevent occurrence of misfiring and unstable engine rotation due to an increase in heat of evaporation, which effect has not been achieved by increasing the engine speed for warming-up or the like after a change from the starting increase mode to the ordinary control mode.

INDUSTRIAL APPLICABILITY

The present invention is useful as a control method for starting a diesel engine, which makes it possible to prevent an excessive increase in fuel injection rate in a low speed rotation range, at the time of starting, for prevention of occurrence of misfiring and unstable engine rotation, to reliably increase the rotating speed of the engine at a low temperature where the resistance to rotation is large, and to prevent occurrence of black smoke from surplus fuel by controlling the injection rate according to the engine temperature.

What is claimed is:

1. A control method for starting a diesel engine, wherein said engine has a control rack for adjusting a rate of fuel injection into the engine, and wherein said control rack has a set position for ordinary control of the rate of fuel injection into the engine, said method comprising the steps of:

at the time of beginning the starting of the engine, positioning said control rack at a starting position on a fuel injection rate increasing side of said set position;

moving said control rack from said starting position in the fuel injection rate reducing direction to a first position, wherein said first position corresponds to a predetermined first engine rotating speed, so that the rack position has a predetermined first gradient, with respect to the engine rotating speed, between the beginning of engine starting and said predetermined first engine rotating speed; and then moving said control rack from said first position in the fuel injection rate reducing direction toward a second position, wherein said second position corresponds to a second engine rotating speed at which said control rack is at said set position, so that the rack position has a predetermined second gradient, with respect to the engine rotating speed, between said first engine rotating speed and second engine rotating speed, said second gradient being greater than said first gradient.

2. A method in accordance with claim 1, wherein the step of moving said control rack from said first position in the fuel injection rate reducing direction toward a second position comprises moving said control rack from said first position in the fuel injection rate reducing direction to said set position.

3. A method in accordance with claim 1, wherein the step of moving said control rack from said starting position in the fuel injection rate reducing direction to said first position corrects for an increase in fuel injection rate accompanying an increase in engine rotating speed.

4. A method in accordance with claim 1, wherein a ratio of a difference between said first engine rotating speed and said second engine rotating speed to said first engine rotating speed is higher than 20%, when said ratio is expressed as a percentage.

5. A method in accordance with claim 1, further comprising the steps of determining a temperature of the engine, and changing said starting position in accordance with the thus determined temperature.

6. A method in accordance with claim 1, further comprising the steps of:

determining a temperature of the engine;

if the thus determined temperature of the engine is not higher than a predetermined temperature, moving said control rack in the fuel injection rate reducing direction from said first position along said second gradient until said control rack reaches a predetermined position along said second gradient, and then moving said control rack from said predetermined position at a predetermined third gradient with respect to the engine rotating speed until the engine rotating speed increases to a predetermined third engine rotating speed which is higher than said second engine rotating speed, wherein said third gradient is smaller than said second gradient.

7. A method in accordance with claim 6, wherein the step of moving said control rack from said starting position in the fuel injection rate reducing direction to said first position corrects for an increase in fuel injection rate accompanying an increase in engine rotating speed.

8. A method in accordance with claim 6, wherein a ratio of a difference between said first engine rotating speed and said second engine rotating speed to said first engine rotating speed is higher than 20%, when said ratio is expressed as a percentage.

9. A method in accordance with claim 6, further comprising the step changing said starting position in accordance with the thus determined temperature.

10. A method in accordance with claim 1, further comprising the steps of:

determining a temperature of the engine; and if the thus determined temperature of the engine is not higher than a predetermined temperature, moving said control rack from said first position in the fuel injection rate reducing direction along said second gradient until said control rack reaches a predetermined position along said second gradient, and then maintaining said control rack at said predetermined position until the engine rotating speed increases to a predetermined third engine rotating speed which is higher than said second engine rotating speed.

11. A method in accordance with claim 10, further comprising the step of:

returning said control rack to said set position when the engine rotating speed has increased to said third engine rotating speed.

12. A method in accordance with claim 10, wherein the step of moving said control rack from said starting position in the fuel injection rate reducing direction to said first position corrects for an increase in fuel injection rate accompanying an increase in engine rotating speed.

13. A method in accordance with claim 10, wherein a ratio of a difference between said first engine rotating speed and said second engine rotating speed to said first engine rotating speed is higher than 20%, when said ratio is expressed as a percentage.

14. A method in accordance with claim 10, further comprising the step of changing said starting position in accordance with the thus determined temperature.

15. A control method for starting a diesel engine, wherein said engine has a rack for adjusting a rate of fuel injection into the engine, said method comprising the steps of:

storing ordinary control rack positions with respect to engine rotating speed during ordinary mode control for various operating speeds;

storing starting control rack positions with respect to engine rotating speed during starting of the engine;

at the time of beginning the starting of the engine providing a start signal, in response to the existence/absence of the start signal, selecting between an ordinary control mode and a starting mode, if the ordinary control mode is selected, providing a speed instruction, and positioning the rack in accordance with the speed instruction and the thus stored ordinary control rack positions; and if the starting mode is selected, positioning the rack in accordance with the thus stored starting control rack positions, including:

positioning the rack at a starting position on a fuel injection rate increasing side of an ordinary control rack position;

moving said rack from said starting position in the fuel injection rate reducing direction to a first position, wherein said first position corresponds to a predetermined first engine rotating speed, so that the rack position has a predetermined first gradient, with respect to the engine rotating speed, between the beginning of engine starting and said predetermined first engine rotating speed; and then moving said rack from said first position in the fuel injection rate reducing direction toward a second position, wherein said second position corresponds to a second engine rotating speed at which said rack is at said set position, so that the rack position has a predetermined second gradient, with respect to the engine rotating speed, between said first engine rotating speed and second engine rotating speed, said second gradient being greater than said first gradient.

16. A method in accordance with claim 15, wherein said starting mode is selected in response to the existence of a start signal and the ordinary control mode is selected in response to the absence of a start signal.

17. A method in accordance with claim 15, further comprising determining a temperature of the engine, correcting a thus stored starting control rack position with the thus determined temperature to provide a temperature corrected rack position, and wherein said starting mode is selected in response to the existence of a start signal and said temperature corrected rack position.

18. A method in accordance with claim 17, where the step of determining a temperature of the engine comprises sensing a temperature of cooling water for the engine.

19. Apparatus for operating a diesel engine, said engine having a rack for controlling a pump for injecting fuel into the engine, said apparatus comprising:

an actuator for adjusting a position of the rack;

a controller having an ordinary mode output section, a starting increase mode output section, a mode selection circuit, and a deviation calculation circuit;

said ordinary mode output section being adapted to store ordinary control rack positions with respect to engine rotating speed during ordinary mode control for various operating speeds;

said starting increase mode output section being adapted to store starting control rack positions with respect to engine rotating speed during starting of the engine;

a sensor for providing a speed instruction to said ordinary mode output section, a sensor for providing an engine rotational speed signal to each of said ordinary mode output section, said starting increase mode output section, and said mode selection circuit;

a device for providing a start signal to said mode selection circuit at the time of beginning the starting of the engine;

a device for providing to said deviation calculation circuit a rack position signal representative of the actual position of the rack;

whereby responsive to the existence/absence of said start signal said mode selection circuit selects a signal responsive to an output of said ordinary mode output section or a signal responsive to an output of said starting increase mode output section and outputs the thus selected signal to said deviation calculation circuit;

whereby the deviation calculation circuit determines a difference between a rack position represented by the thus selected signal and the actual rack position represented by the rack position signal;

wherein the actuator is controlled responsive to the thus determined difference; and wherein at the time of beginning the starting of the engine, said starting increase mode output section provides an output signal for positioning said rack at a starting position on a fuel injection rate increasing side of an ordinary control rack position, and then for moving said rack from said starting position in the fuel injection rate reducing direction to a first position, wherein said first position corresponds to a predetermined first engine rotating speed, so that the rack position has a predetermined first gradient, with respect to the engine rotating speed, between the beginning of engine starting and said predetermined first engine rotating speed, then for moving said rack from said first position in the fuel injection rate reducing direction toward a second position, wherein said second position corresponds to a second engine rotating speed at which said rack is at an ordinary control rack position, so that the rack position has a predetermined second gradient, with respect to the engine rotating speed, between said first engine rotating speed and second engine rotating speed, said second gradient being greater than said first gradient.

20. Apparatus in accordance with claim 19, further comprising a temperature correction circuit for receiving a signal from the starting increase mode output section and providing a temperature corrected signal to said mode selection circuit as said signal responsive to an output of said starting increase mode output section, and a sensor for determining a temperature of the engine and for applying a temperature signal to the temperature correction circuit.

* * * * *